US010336583B2

(12) United States Patent
Solomon et al.

(10) Patent No.: US 10,336,583 B2
(45) Date of Patent: Jul. 2, 2019

(54) LIFTER AND METHOD FOR MOVING TRAFFIC BARRIERS

(71) Applicant: Vacuworx Global, LLC, Tulsa, OK (US)

(72) Inventors: William J. Solomon, Tulsa, OK (US); Justin Hendricks, Tulsa, OK (US)

(73) Assignee: Vacuworx Global, LLC, Tulsa, OK (US)

( * ) Notice: Subject to any disclaimer, the term of this patent is extended or adjusted under 35 U.S.C. 154(b) by 0 days.

(21) Appl. No.: 15/943,327

(22) Filed: Apr. 2, 2018

(65) Prior Publication Data

US 2018/0354756 A1 Dec. 13, 2018

Related U.S. Application Data

(63) Continuation of application No. 15/268,794, filed on Sep. 19, 2016, now Pat. No. 9,932,207, which is a continuation-in-part of application No. 14/608,703, filed on Jan. 29, 2015, now Pat. No. 9,446,933, which is a continuation-in-part of application No. 13/974,559, filed on Aug. 23, 2013, now abandoned.

(60) Provisional application No. 61/692,747, filed on Aug. 24, 2012.

(51) Int. Cl.

| | |
|---|---|
| ***B66C 1/00*** | (2006.01) |
| ***B66C 1/44*** | (2006.01) |
| ***E01F 15/00*** | (2006.01) |
| ***B66C 1/02*** | (2006.01) |
| ***B66C 23/18*** | (2006.01) |

(52) U.S. Cl.

CPC ..... *B66C 1/00* (2013.01); *B66C 1/0262* (2013.01); *B66C 1/0287* (2013.01); *B66C 1/44* (2013.01); *B66C 1/445* (2013.01); *B66C 23/18* (2013.01); *E01F 15/006* (2013.01)

(58) Field of Classification Search

CPC ..... B66C 1/02; B66C 3/16; B66C 19/007; B66C 1/00; B66C 1/44; B66C 1/0287; B66C 1/0262; B66C 1/445; B66C 23/18; B65G 47/91; B65G 1/045; B25J 15/00; B25J 15/0009; B25J 9/023; E21B 31/20; E01F 13/12; E01F 15/006; E01C 19/52; E01C 19/42; E01C 19/266; B23Q 7/04; B60P 3/1091

See application file for complete search history.

(56) References Cited

U.S. PATENT DOCUMENTS

| | | | |
|---|---|---|---|
| 1,436,197 | A | 11/1922 | Rohland |
| 3,044,819 | A | 7/1962 | Pierre |
| 3,771,825 | A | 11/1973 | Yamada et al. |

(Continued)

FOREIGN PATENT DOCUMENTS

| | | |
|---|---|---|
| CA | 2349359 A1 | 11/2002 |
| CL | 275211 | 11/2011 |

(Continued)

*Primary Examiner* — Stephen A Vu
(74) *Attorney, Agent, or Firm* — Gable Gotwals

(57) ABSTRACT

A traffic barrier lifter mountable on a boom and having a gearbox with a first and a second rotating axis; a pair of opposing arms directly mounted to the first and second rotating axis and a rotator capable of rotating the lifter relative to the boom, wherein the gearbox is capable of moving the pair of opposing arms from an open position to a closed position such that the arms can clamp onto a traffic barrier. The rotator being capable of rotating the arms and traffic barrier relative to the boom.

19 Claims, 9 Drawing Sheets

(56) References Cited

U.S. PATENT DOCUMENTS

| | | | |
|---|---|---|---|
| 3,982,782 | A | 9/1976 | Bos |
| 4,084,306 | A | 4/1978 | Barker |
| 4,542,929 | A | 9/1985 | Possinger |
| 4,666,332 | A | 5/1987 | Burgett |
| 4,709,953 | A | 12/1987 | Sirota |
| 4,858,979 | A | 8/1989 | Parma |
| 5,056,845 | A | 10/1991 | Cook |
| 5,088,874 | A | 2/1992 | Quittner |
| 5,161,846 | A | 11/1992 | Yakou |
| 5,171,053 | A | 12/1992 | Rouleau |
| 5,246,305 | A | 9/1993 | Peek |
| 5,253,951 | A | 10/1993 | Peek |
| 5,403,114 | A | 4/1995 | James |
| 5,967,582 | A | 10/1999 | Saito |
| 6,227,950 | B1 | 5/2001 | Hempel et al. |
| 6,557,695 | B2 | 5/2003 | Gerber et al. |
| 7,024,887 | B2 | 4/2006 | Tijerina-Ramos et al. |
| 7,604,584 | B1 | 10/2009 | Wu et al. |
| 8,109,692 | B2 | 2/2012 | Welch et al. |
| 9,446,933 | B1 | 9/2016 | Solomon et al. |
| 2005/0168001 | A1 | 8/2005 | Perlman et al. |

FOREIGN PATENT DOCUMENTS

| | | |
|---|---|---|
| JP | 1986031689 | 2/1986 |
| JP | 1990079382 | 6/1990 |
| JP | H047206 A | 1/1992 |
| JP | 1995252084 | 10/1995 |
| JP | 1998194655 | 7/1998 |

LIFTER AND METHOD FOR MOVING TRAFFIC BARRIERS

1. CROSS-REFERENCE TO RELATED APPLICATIONS

The present application is a continuation in part of U.S. patent application Ser. No. 13/974,559 filed on Aug. 23, 2013 which is a conversion and continuation-in-part of U.S. Provisional Patent Application No. 61/692,747 filed on Aug. 24, 2012. Both of these preceding application are incorporated herein by reference.

2. FIELD OF THE INVENTION

The present invention relates generally to traffic barriers. More particularly, the present invention relates to a device to move traffic barriers.

3. BACKGROUND OF THE INVENTION

Traffic barriers, sometimes referred to as Jersey walls, are commonly used to form a temporary wall between two lines of traffic or between a line of traffic and a construction zone. The traffic barriers typically range in length from 10 to 30 feet. They are constricted of steel reinforced concrete and can weigh between 8,000 and 20,000 lbs depending upon their length and cross sectional area. While the exact geometry can vary, they typically have a wide base which narrow towards the top. While some manufactures put an indented trough in the upper portion of the barrier which runs the length of the barrier, many manufactures make all of the upper barrier a continuous flat surface.

Because these traffic barriers are used for temporary protection, they are often moved around a job site and then from job site to job site. As can be imagined moving a 10,000 lb piece of steel reinforced concrete can be challenging. This is especially true on a road construction site where care must be taken so that the barrier or equipment moving the barrier does not accidentally end up in the traffic zone.

The most common practice is to move the barriers using an excavator or frontend loader. This requires a worker to chain the barriers to the bucket of the excavator or frontend loader. An equipment operator can then lift and reposition the barrier with the excavator or frontend loader. This method provides an opportunity for the worker handling the chains to either be hit with a barrier or have one fall on top of him. Both of which can result in serious injury.

What is needed, therefore, is a safe and effective way to move a traffic barrier without having a worker physically attach a chain, cable or sling to the barrier.

4. BRIEF DESCRIPTION OF THE INVENTION

The present invention is a traffic barrier lifter having a pair of opposing arms. The arms may be pivotal or otherwise articulated to move in a clamping motion relative to one another. The arms are operable to enclose two opposing sides of a traffic barrier. The traffic barrier lifter being attachable the boom of an excavator, backhoe or other appendage of a piece of heavy equipment.

The lifter has a rotator. The rotator being capable of rotating the traffic barrier lifter and its load relative to the boom supporting it.

Further features may include one or more pinned connections that allow the lifter to adjust to better align with and grip the a

5. BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

6. DETAILED DESCRIPTION OF THE PREFERRED EMBODIMENT(S)

Figure 1:
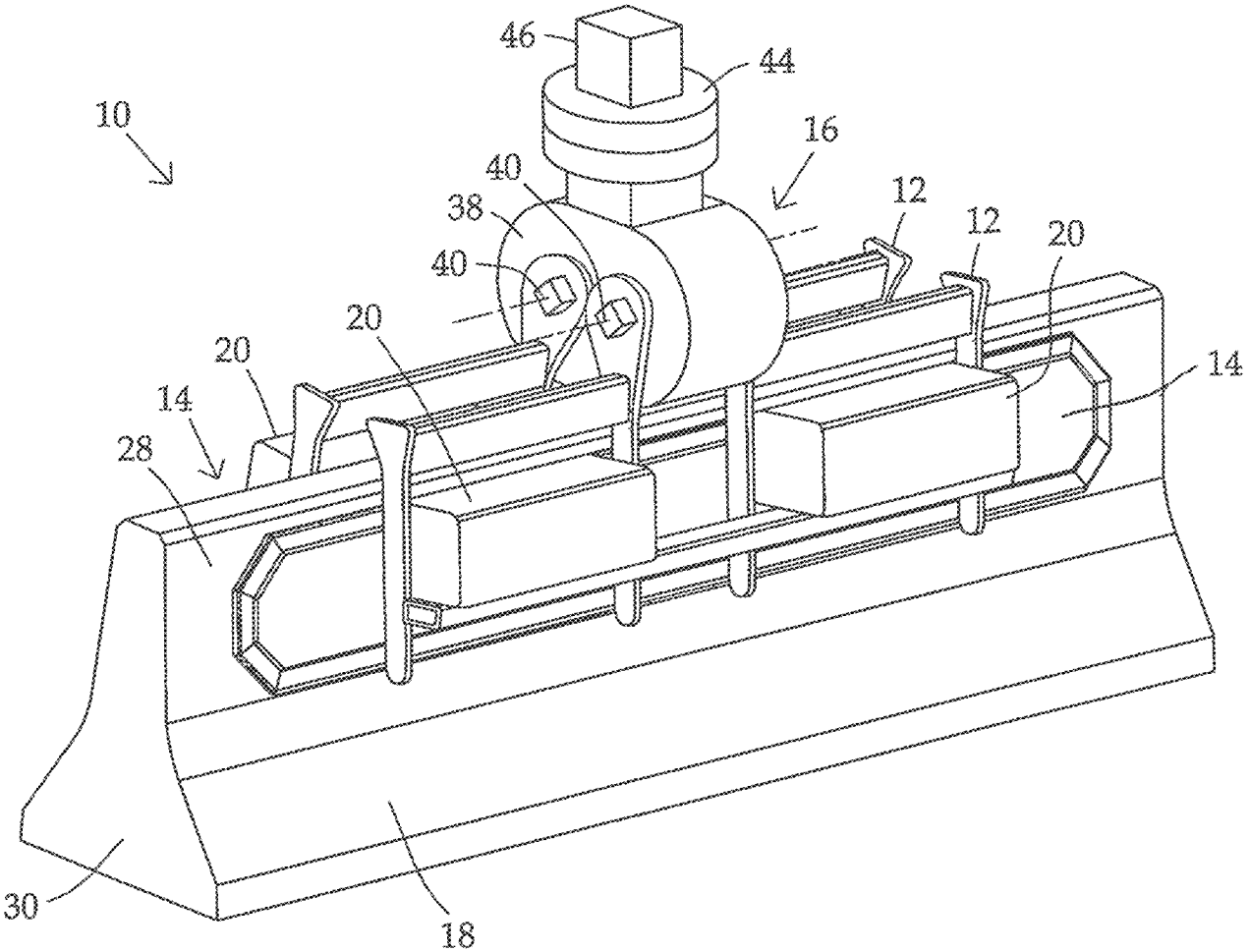
FIG. 1 is a perspective view of one embodiment of the traffic barrier mover of the present invention attached to a traffic barrier.

Turning now to the drawings wherein like reference characters indicate like or similar parts throughout, FIG. 1 illustrates a first embodiment of the traffic barrier lifter 10 of the present invention. The lifter 10 has a pair of opposing arms 12 carrying a vacuum pad 14. An articulating mechanism 16 opens and closes the opposing arms 12 such that the vacuum pads 14 can clamp onto a traffic barrier 18.

Figure 3:
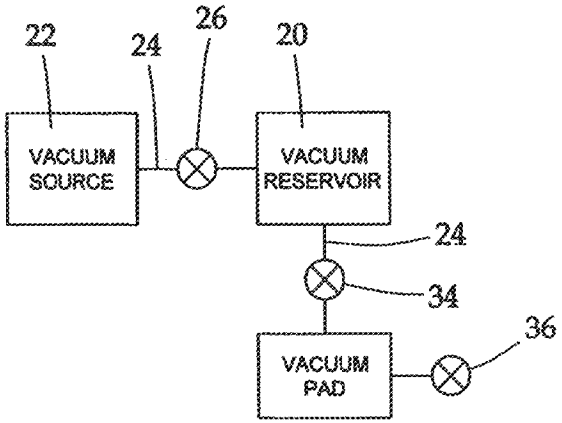
FIG. 3 is a piping diagram of the vacuum circuit used in the vacuum embodiment of the present invention.

Each pad may be equipped with one or more vacuum reservoirs 20. These reservoirs 20 are in fluid communication with a vacuum source 22. The vacuum line 24 running from the reservoir 20 to the vacuum source 22 has a check valve 26. In the event of a power failure to the vacuum source 22 or failure of the vacuum source 22 itself, the check valve 26 closes to maintain vacuum in the reservoir 20. See FIG. 3. This provides time for the equipment operator to lower the barrier 18 before the vacuum grip on the barrier 18 is dropped.

The vacuum pad 14 has a front side 28 and a backside 30. In the vacuum embodiment the vacuum reservoir 20 may be mounted on the backside 30 of the vacuum pad 14 as shown in FIG. 1. In other embodiments they may be remotely mounted. The front side 28 of the vacuum pad 14 preferably has a elastomeric seal 32 extending around the perimeter. See FIG. 4. The seal 32 comes into contact the surface of the barrier 18 and provides a temporary seal between the pad 14 and the barrier 18. Once the seal 32 is in contact with the barrier 18 a valve 34 is opened between the vacuum reservoir and the space created between the front side 28 of the pad 14, the surface of the barrier 18 and the seal 32. This puts the vacuum reservoir 20 and this space in fluid communication and creates a vacuum grip between the pad 14 and the barrier 18. To release this vacuum grip the valve 34 between the vacuum reservoir 20 and this space is closed and a second valve 36 is opened which breaks the vacuum.

Figure 2:
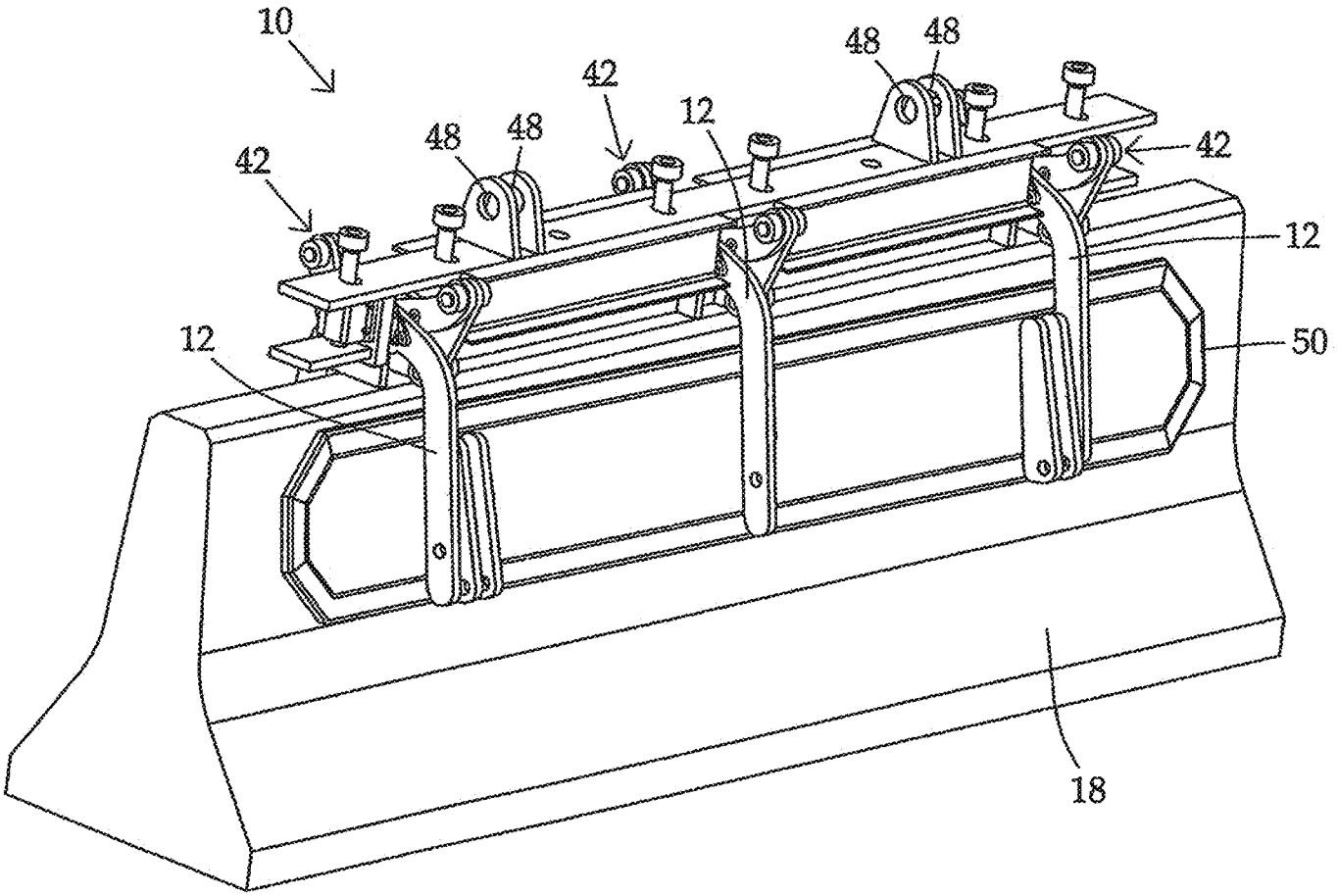
FIG. 2 is a perspective view of a second embodiment of the present invention with an over center hinged mechanism.

In the vacuum embodiment the articulating mechanism 16 is gear drive 38 which rotates both arms 12 about parallel axis 40. Other articulating mechanisms can be used while still falling within the scope of this invention. This includes but is not limited to holding the first arm 12 stationary relative to the lifter 10 while moving the second or opposing arm 12 relative to the first arm 12. It is also possible to use an over center linkage 42 as the articulating mechanism 16 as shown in FIG. 2. The over center linkage 42 increases the force of the arms 12 towards one another as the weight of the barrier 18 being lifted increases.

Other options with the present invention include providing the vacuum grip 44, i.e. the seal 32, valves 34 and 36 and vacuum source, to only one of the pads 14. Thus only a single vacuum pad 14 would pull suction on the barrier 18.

Yet another option is to provide a rotator 44 attached to the gear drive 38. The lifter 10 would then be mounted to the boom 46 of an excavator or backhoe. The rotator 44 would preferably be hydraulically powered, however other means of power known in the industry could also be used. The rotator 44 rotates the lifter 10 relative to the boom 46. Additionally the lifter 10 could be mounted on a frontend loader either with or without the rotator 44.

FIG. 2 shows a perspective view of another embodiment of the lifter 10 of the present invention. This embodiment utilizes an over center linkages 40, discussed above to articulate the vacuum pads 14. This embodiment of the lifter 10 can be mounted to a vacuum lifter beam, such as a VACUWORX® RC10, via the lugs 48. The vacuum lifter beam would provide a suction source and vacuum reservoir to the pads 50 via a vacuum line. Hydraulic power from the excavator or external power pack would power the over center linkage 40.

Other configurations of the present invention include but are not limited to mounting the vacuum source 22 on an outrigger on the back of the excavator such that it works as a counter weight to the boom 46. Likewise the vacuum reservoir 20 and/or a hydraulic power supply could also be mounted on an outrigger on the back of the excavator. Vacuum and/or hydraulic power would then be supplied to the lifter 10 via suitable piping and tubes.

Figure 4:
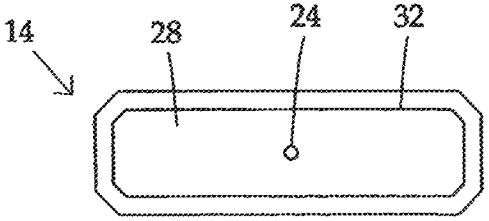
FIG. 4 is the front side of a vacuum pad for the present invention.
Figure 5:
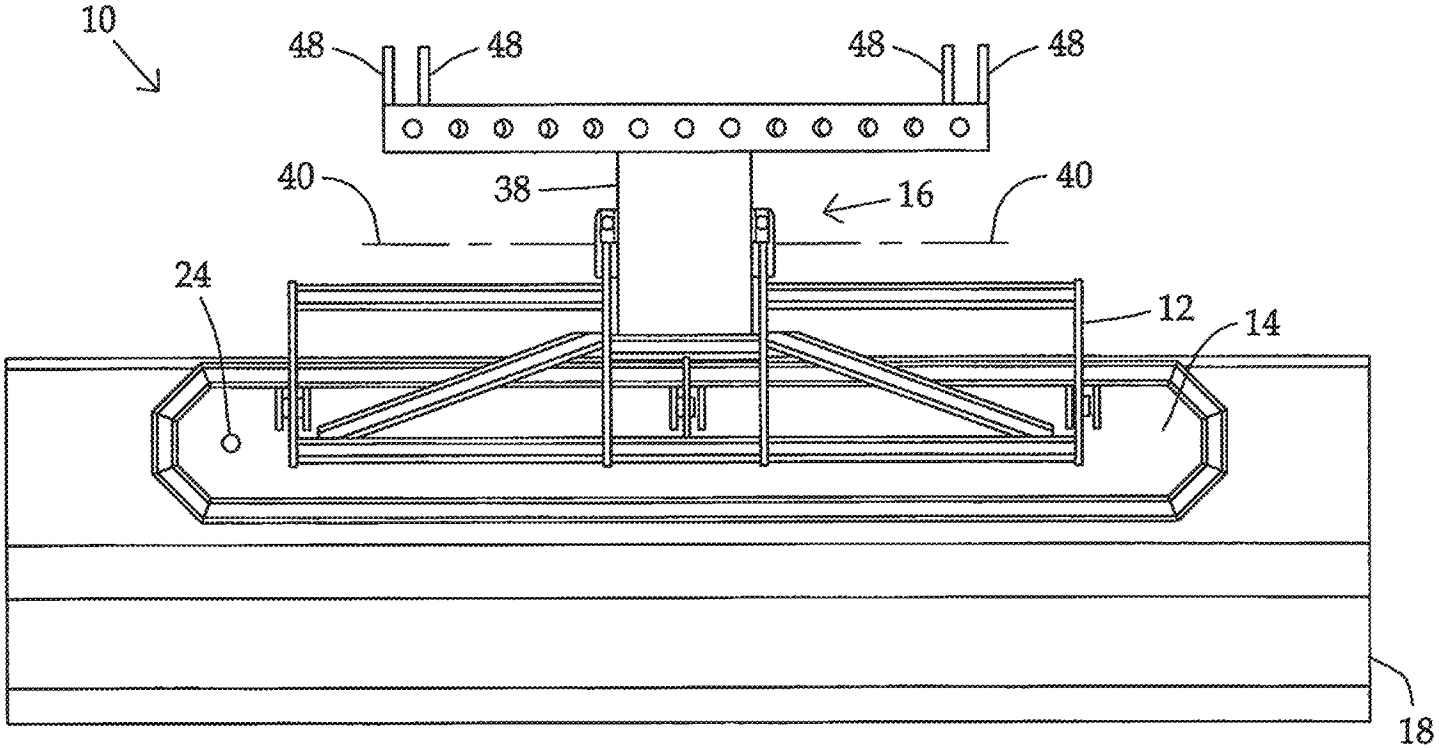
FIG. 5 is a front view of the vacuum embodiment of the traffic barrier mover of the present invention attached to a traffic barrier.
Figure 6:
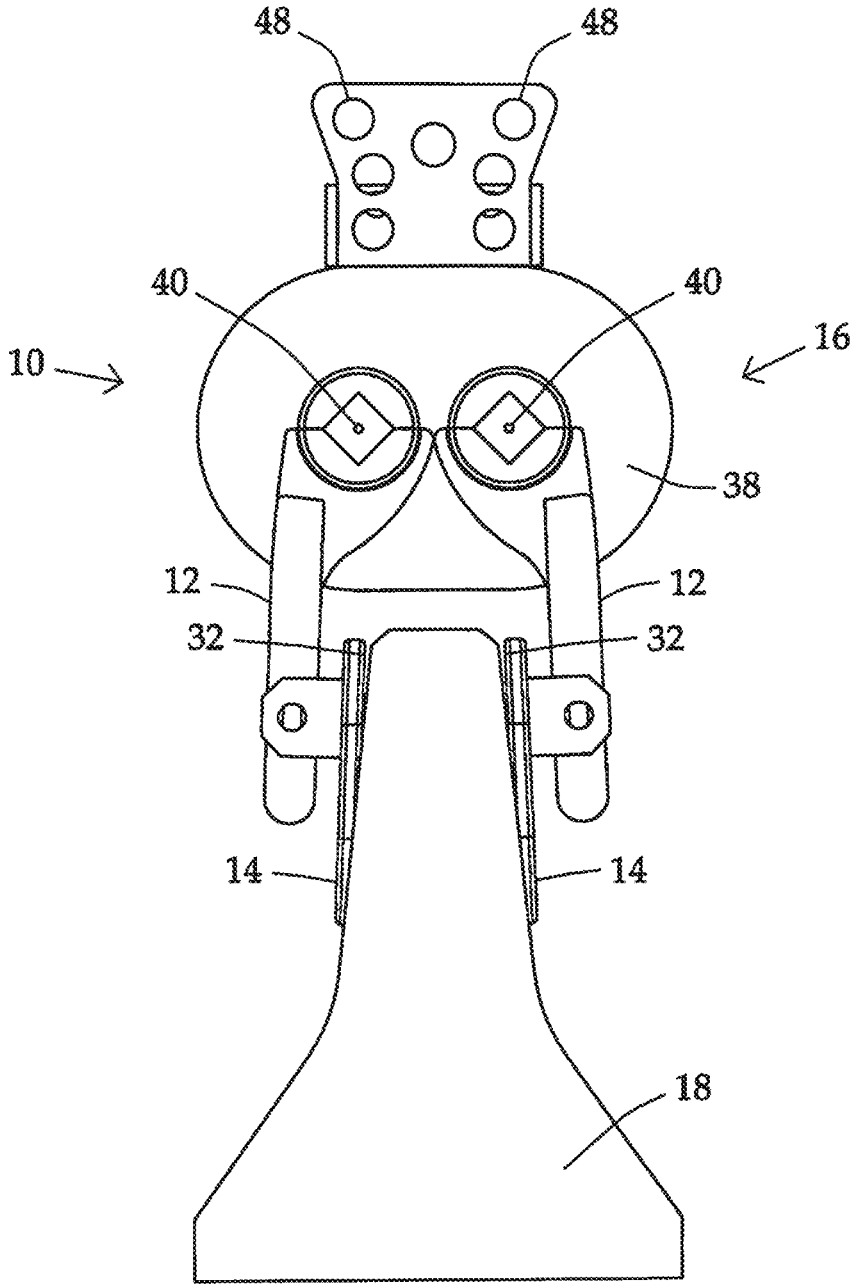
FIG. 6 is an end view of the vacuum embodiment of the traffic barrier mover of the present invention attached to a traffic barrier.
Figure 7:
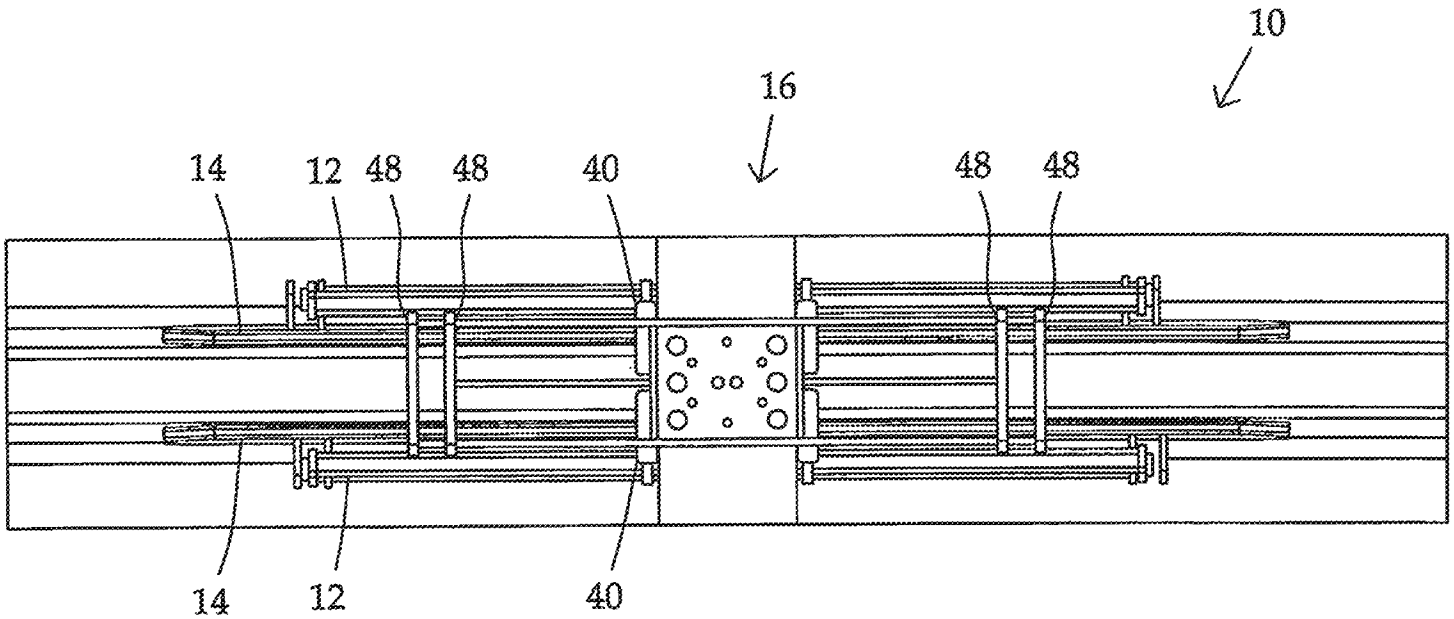
FIG. 7 is a top view of the vacuum embodiment of the traffic barrier mover of the present invention attached to a traffic barrier.

FIGS. 5, 6 and 7 show the vacuum embodiment of the lifter 10 holding a traffic barrier 18. It has a gear drive 38 as the articulating mechanism 16. A pair of arms 12 each are attached to a vacuum pad 14. The vacuum pads 14 are constructed as shown in FIG. 4 The arms 12 are also pivotally attached the gear drive 38 and pivot relative to the gear drive 38 on two parallel axis 40. The pneumatic circuit for the lifter 10 are the same as that shown in FIG. 3.

The lifter 10 of FIGS. 5 through 7 has plurality of lugs 48 connected to the gear drive 38. The lugs 48 can be used to secure the lifter 10 to a vacuum lifter beam, such as a VACUWORX® RC10, or similarly designed vacuum lifter beam. The vacuum lifter beam would provide a suction source and vacuum reservoir to the pads 14 via a vacuum line 24. It would be used in conjunction with an excavator or other machinery with boom 46. Hydraulic power from the excavator or external power pack would power the gear drive 38.

In the embodiment shown in FIGS. 5-7, a rotator 44 may be located between the boom 46 and the vacuum lifter beam. The rotator 44 would be able to rotate the vacuum lifter beam, lifter 10 and traffic barrier 18 relative to the boom 46. Hydraulic power from the excavator or external power pack would power the rotator 44.

Figure 8:
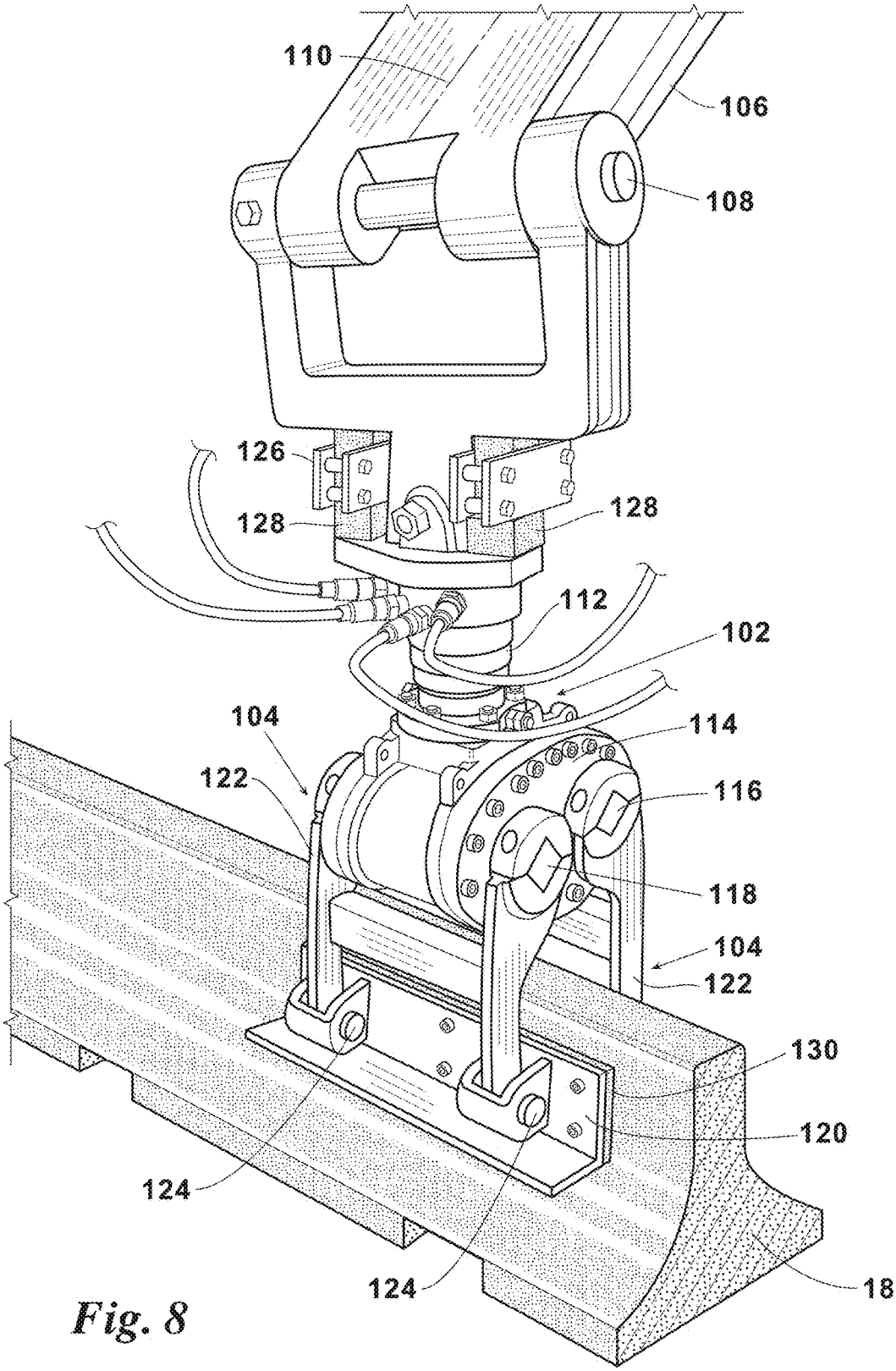
FIG. 8 is a perspective view of a second embodiment of the present invention mounted on a boom of an excavator and lifting a traffic barrier.
Figure 9:
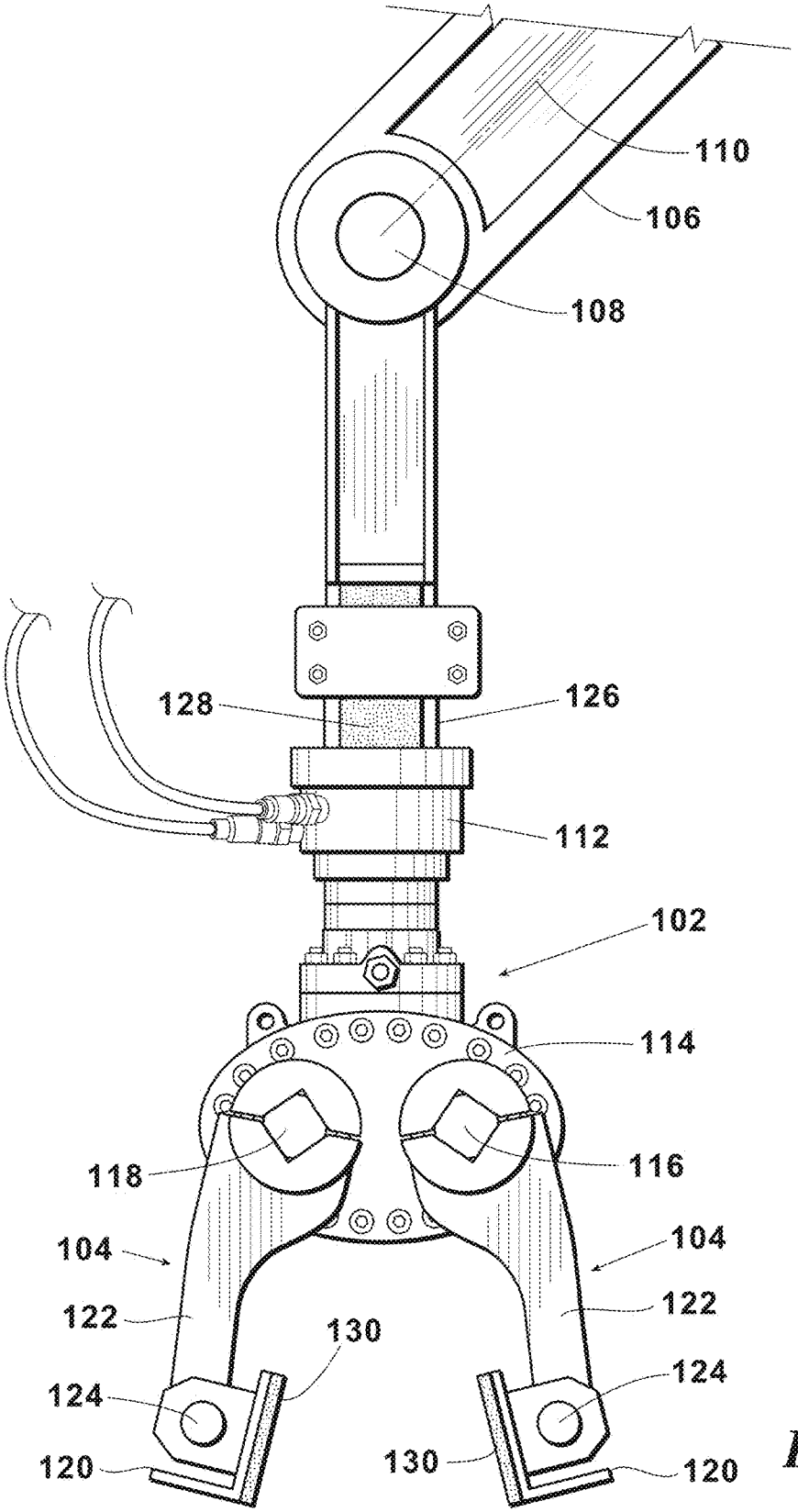
FIG. 9 is an end view of the second embodiment of the present invention.
Figure 10:
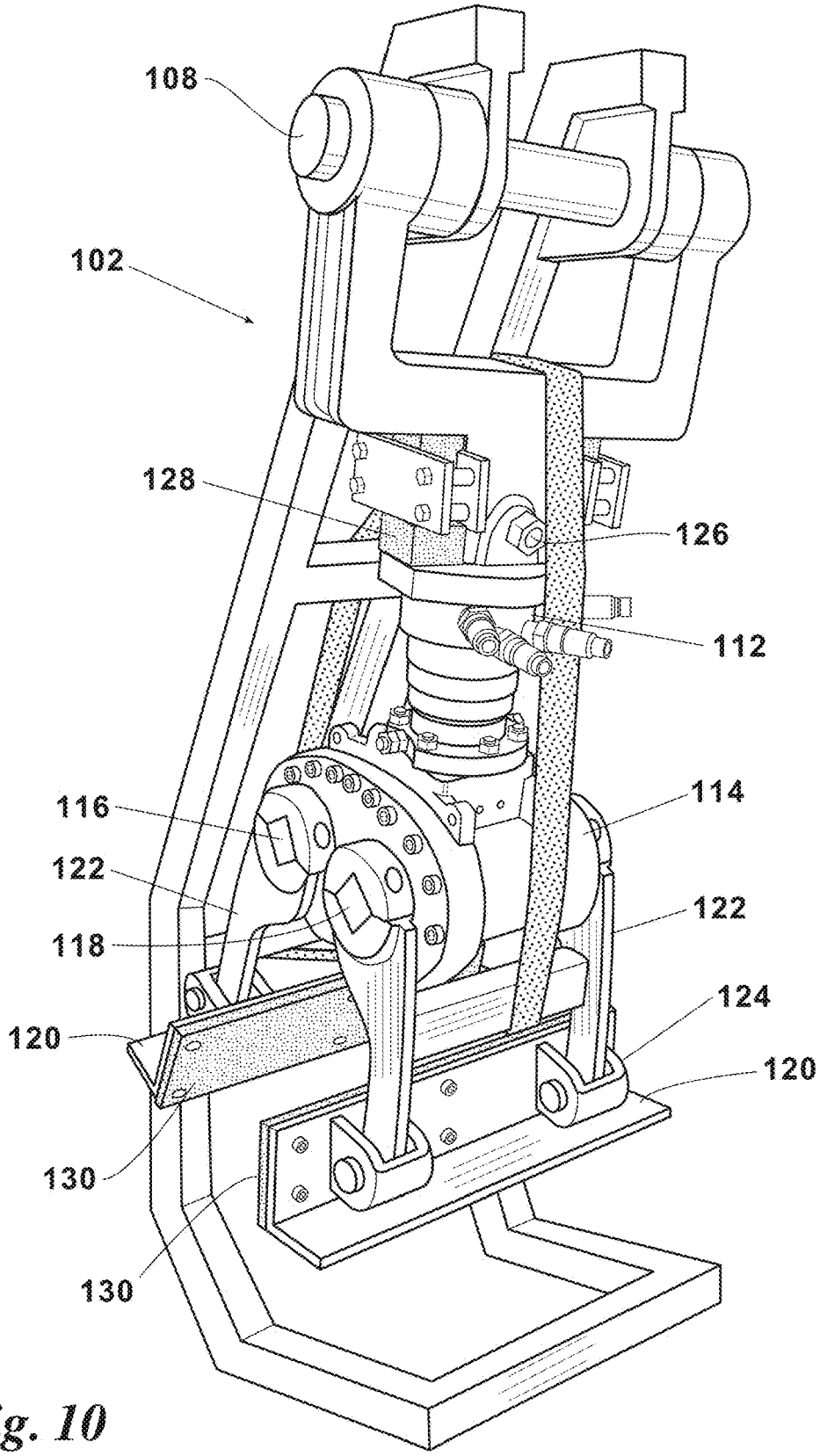
FIG. 10 is a perspective view of the second embodiment of the present invention on a shipping stand suspended by its first pinned connection and secured by a shipping strap.

FIGS. 8-10 show another embodiment of traffic barrier lifter 102 of the present invention. In this second embodiment the traffic barrier lifter 102 does not use vacuum pressure to grip the traffic barrier 18. Instead it uses the pressure between two arms 104 to grasp the traffic barrier 18.

The lifter 102 attached to the end of a boom 106 of an excavator, backhoe or other heavy equipment. In the preferred embodiment shown in FIG. 8, the lifter 102 is pivotally attached to the boom 106 via a first pinned connection 108. The pin and axis of rotation of the first pinned connection 108 is perpendicular to the axis 110 of the boom 106. The lifter 102 has a rotator 112 which is capable of rotating the lifter 102 and its load relative to the boom 106. A gearbox 114 is attached to the rotator 112 with a first and second rotating axis 116 and 118. In the preferred embodiment of the lifter 102, one arm of the pair of arms 104 is directly attached to the first rotating axis 116 and the second arm of the pair of arms 104 is directly attached to the second rotating axis 118. It would be possible to also construct the present invention lifter 102 using one fixed arm 104 and a second arm 104 attached to a rotating axis 116 and 118 of the gearbox 114.

In the preferred embodiment of the lifter 102 shown in FIGS. 8-10, each arm 104 has a cross member 120 that is pivotally attached to the one or more links 122 which connect back to the first and second rotating axis 116 and 118. The axis of pivot 124 between the cross members 120 and links 122 is parallel to the first and second rotatable axis 116 and 118 of the gearbox 114. This allows the cross members 120 to rotate to a position where they are flat with the opposing surfaces of the traffic barrier 18. The cross members 118 may be provided with a layer 130 of rubber, plastic or other material to provide increased friction when gripping a traffic barrier 18.

The lifter 102 may also have second pinned connection 126 located between the first pinned connection 108 and the gearbox 114 and preferably between the first pinned connection 108 and the rotator 112. The pin and axis of rotation of the second pinned connection 126 is perpendicular to the pin and axis of rotation of the first pinned connection 108. Movement in the second pinned connection 126 may be dampened by blocks of resilient material 128 such as rubber located on either side of the second pinned connection 126.

In the preferred embodiment of the lifter 102 shown in FIGS. 8-10 the rotator 112 and gearbox are hydraulically powered. However it is possible to use other means to power the lifter 102.

When using the lifter 102 shown in FIGS. 8-10, it is positioned over the traffic barrier 18. The rotator 112 is operated to align the cross members 120 of the arms 104 with the traffic barrier 18. The first and second rotatable axis 116 and 118 are operated to place the cross members 120 wide enough to clear the sides of the traffic barrier 18, i.e. an open position as seen in FIG. 9. The boom 106 and lifter 102 are lowered onto the traffic barrier 18. the first and second rotatable axis 116 and 118 are then operated such that the cross members 120 are brought into contact with the opposing sides of the traffic barrier 18 with sufficient force to provide frictional forces between the cross members 120 and the opposing sides of the traffic barrier 18 to lift the traffic barrier 18. Thus the lifter 102 is placed in a closed position as seen in FIG. 8 The boom 106, lifter 102 and traffic barrier 18 are then raised.

The boom 106 can then be manipulated to place the traffic barrier over the desired location. The orientation of the traffic barrier 18 (and lifter 102) relative to the boom 106 can be adjusted through operation of the rotator 112. Once the traffic barrier 18 is proper location it is lowered. It is released by operation of the first and second rotatable axis 116 and 118 of the gearbox 114.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A method for lifting a traffic barrier, the method comprising:

operating a rotator of a barrier lifter connected to a boom, the barrier lifter including at least one pinned connector configured for connecting the barrier lifter to the boom;

the rotator located below and connected to the at least one pinned connector, the rotator capable of rotating said lifter relative to the boom;

a pair of opposing axes located below the rotator and running parallel to one another;

a pair of opposing arms, each arm connected at an upper end to a respective axis of the pair of opposing axes, the arms rotatable relative to one another between an open position and a closed position; and a cross-member pivotally connected to a respective lower end of each arm of the pair of opposing arms, the cross-member including a gripping surface;

operating the pair of opposing arms into the open position;

operating the rotator to align the arms with a traffic barrier;

lowering the boom and lifter onto the traffic barrier;

operating the pair of opposing arms into the closed position wherein the gripping surface of each arm is in contact with and applying pressure to a respective opposing surface of the traffic barrier;

lifting the boom, lifter and traffic barrier;

placing the traffic barrier over a desired location;

lowering the boom, lifter and traffic barrier wherein the traffic barrier is placed on the desired location; and operating the pair of arms to return into the open position.

2. The method of claim 1, wherein a block of resilient material is located on each side of the at least one pinned connector.

3. The method of claim 1, wherein the gripping surface of the cross-member includes a vacuum pad.

4. A traffic barrier lifter comprising:

at least one pinned connector configured for connecting said lifter to a boom;

a rotator located below and connected to the at least one pinned connector, the rotator capable of rotating said lifter relative to the boom;

a pair of opposing axes located below the rotator and running parallel to one another;

a pair of opposing arms, each arm connected at an upper end to a respective axis of the pair of opposing axes, the arms rotatable relative to one another between an open position and a closed position;

a cross-member pivotally connected to a respective lower end of each arm of the pair of opposing arms, the cross-member including a gripping surface; and a block of resilient material located on each side of the at least one pinned connector.

5. A traffic barrier lifter according to claim 4, further comprising:

a gearbox including the pair of opposing axes.

6. A traffic barrier lifter according to claim 5, wherein the gearbox is an hydraulically powered gearbox.

7. A traffic barrier lifter according to claim 4, further comprising the gripping surface of the cross-member including a vacuum pad.

8. A traffic barrier lifter according to claim 4, wherein the rotator is an hydraulically powered rotator.

9. A traffic barrier lifter according to claim 4, wherein the pair of opposing arms is an hydraulically powered pair of opposing arms.

10. A traffic barrier lifter comprising:

at least one pinned connector configured for connecting said lifter to a boom;

an hydraulically powered rotator located below and connected to the at least one pinned connector, the rotator capable of rotating said lifter relative to the boom;

a pair of opposing axes located below the rotator and running parallel to one another;

an hydraulically powered pair of opposing arms, each arm connected at an upper end to a respective axis of the pair of opposing axes, the arms rotatable relative to one another between an open position and a closed position;

a cross-member pivotally connected to a respective lower end of each arm of the pair of opposing arms, the cross-member including a gripping surface; and a block of resilient material located on each side of the at least one pinned connector.

11. A traffic barrier lifter according to claim 10, further comprising:

the gripping surface of the cross-member including a vacuum pad.

12. A traffic barrier lifter comprising:

at least one pinned connector configured for connecting said lifter to a boom;

a rotator located below and connected to the at least one pinned connector, the rotator capable of rotating said lifter relative to the boom;

a pair of opposing axes located below the rotator and running parallel to one another;

a pair of opposing arms, each arm connected at an upper end to a respective axis of the pair of opposing axes, the arms rotatable relative to one another between an open position and a closed position; and a cross-member pivotally connected to a respective lower end of each arm of the pair of opposing arms, the cross-member including a gripping surface, the gripping surface including a vacuum pad.

13. A traffic barrier lifter according to claim 12, further comprising:

a block of resilient material located on each side of the at least one pinned connector.

14. A traffic barrier lifter according to claim 12, further comprising:

a gearbox including the pair of opposing axes.

15. A traffic barrier lifter according to claim 14, wherein the gearbox is an hydraulically powered gearbox.

16. A traffic barrier lifter according to claim 12, wherein the rotator is an hydraulically powered rotator.

17. A traffic barrier lifter according to claim 12, wherein the pair of opposing arms is an hydraulically powered pair of opposing arms.

18. A traffic barrier lifter comprising:

at least one pinned connector configured for connecting said lifter to a boom;

an hydraulically powered rotator located below and connected to the at least one pinned connector, the rotator capable of rotating said lifter relative to the boom;

a pair of opposing axes located below the rotator and running parallel to one another;

an hydraulically powered pair of opposing arms, each arm connected at an upper end to a respective axis of the pair of opposing axes, the arms rotatable relative to one another between an open position and a closed position; and a cross-member pivotally connected to a respective lower end of each arm of the pair of opposing arms, the cross-member including a gripping surface, the gripping surface including a vacuum pad.

19. A traffic barrier lifter according to claim 18, further comprising:

a block of resilient material located on each side of the at least one pinned connector.

* * * * *